US010494742B2

(12) United States Patent
Duralti

(10) Patent No.: US 10,494,742 B2
(45) Date of Patent: Dec. 3, 2019

(54) OUTER-YARN BRAKE, A CORDING OR CABLING MACHINE WITH AN OUTER-YARN BRAKE AND A METHOD FOR OPERATING SUCH A CORDING OR CABLING MACHINE

(71) Applicant: Saurer Spinning Solutions GmbH & Co. KG, Uebach-Palenberg (DE)

(72) Inventor: Cenk Duralti, Mönchengladbach (DE)

(73) Assignee: Saurer Spinning Solutions GmbH & Co. KG, Uebach-Palenberg (DE)

( * ) Notice: Subject to any disclaimer, the term of this patent is extended or adjusted under 35 U.S.C. 154(b) by 377 days.

(21) Appl. No.: 15/341,254

(22) Filed: Nov. 2, 2016

(65) Prior Publication Data

US 2017/0130370 A1 May 11, 2017

(30) Foreign Application Priority Data

Nov. 6, 2015 (DE) ..... 10 2015 014 299

(51) Int. Cl.
*D01H 13/10* (2006.01)
*D01H 1/10* (2006.01)
*D01H 7/86* (2006.01)

(52) U.S. Cl.
CPC ..... *D01H 13/106* (2013.01); *D01H 1/10* (2013.01); *D01H 7/86* (2013.01)

(58) Field of Classification Search
CPC ..... D01H 1/10; D01H 1/105; D01H 1/106; D01H 7/86; D01H 7/868; D01H 7/88; D01H 13/104; D01H 13/106
See application file for complete search history.

(56) References Cited

U.S. PATENT DOCUMENTS 1,826,354 A * 10/1931 Lenk ..... D01H 13/106 242/149
3,783,597 A * 1/1974 Greive ..... D01H 13/106 242/128
4,030,683 A * 6/1977 Eckholt ..... D01H 15/007 242/149

(Continued)

FOREIGN PATENT DOCUMENTS

DE 27 26 603 A1 12/1978
DE 41 21 913 A1 1/1992

(Continued)

*Primary Examiner* — Shaun R Hurley
(74) *Attorney, Agent, or Firm* — Nelson Mullins Riley & Scarborough LLP

(57) ABSTRACT

An outer-yarn brake (14) for a cording or cabling machine with at least one workstation comprising a bobbin rack (2) for holding at least one feed bobbin (4), a spindle (12) for the rotation of a yarn (6) withdrawn from the feed bobbin (4) around a bobbin pot associated with the spindle (12), and a yarn-guide channel (10) for guiding the yarn (6) received via a free end-portion (8) of the yarn-guide channel (10) to the spindle (12). The outer-yarn brake (14) can be arranged in the yarn running direction of the withdrawn yarn (6) between the feed bobbin (4) and the yarn-guide channel (10) to guide through the withdrawn yarn (6) and comprises a clamping portion for defined braking of the running yarn (6). The outer-yarn brake (14) can be coupled to the free end-portion (8) in order to form a yarn input for the yarn-guide channel (10).

13 Claims, 3 Drawing Sheets

(56) References Cited

U.S. PATENT DOCUMENTS

| | | | | | |
|---|---|---|---|---|---|
| 4,297,834 | A * | 11/1981 | Franzen | D01H 13/106 | 242/147 M |
| 4,468,920 | A * | 9/1984 | Lorenz | D01H 13/106 | 242/149 |
| 4,928,463 | A * | 5/1990 | Frentzel-Beyme | D01H 13/106 | 242/147 R |
| 4,932,198 | A * | 6/1990 | Eisenhauer | D01H 1/10 | 57/352 |
| 5,136,833 | A * | 8/1992 | Inger | D01H 9/16 | 242/476 |
| 5,155,988 | A * | 10/1992 | Nieratschker | D01H 7/86 | 57/279 |
| 5,581,988 | A * | 12/1996 | Fink | B65H 59/22 | 57/113 |
| 2002/0000084 | A1* | 1/2002 | Scheufeld | D01H 13/106 | 57/58.83 |
| 2002/0002814 | A1* | 1/2002 | Scheufeld | D01H 13/10 | 57/58.49 |
| 2010/0199625 | A1* | 8/2010 | Leupers | D01H 1/10 | 57/354 |
| 2011/0146221 | A1* | 6/2011 | Beckers | D01H 13/106 | 57/58.86 |
| 2017/0350041 | A1* | 12/2017 | Pede-Vogler | D01H 7/86 | |

FOREIGN PATENT DOCUMENTS

| | | | |
|---|---|---|---|
| DE | 200 11 153 | U1 | 10/2001 |
| DE | 100 32 141 | A1 | 1/2002 |
| DE | 10 2007 043 352 | A1 | 3/2009 |
| DE | 10 2009 058 979 | A1 | 6/2011 |
| EP | 0 534 287 | A1 | 3/1993 |

* cited by examiner

Prior Art

OUTER-YARN BRAKE, A CORDING OR CABLING MACHINE WITH AN OUTER-YARN BRAKE AND A METHOD FOR OPERATING SUCH A CORDING OR CABLING MACHINE

CROSS-REFERENCE TO RELATED APPLICATIONS

This application claims priority from German National Patent Application No. DE 10 2015 014 299.2, filed Nov. 6, 2015, entitled "Außenfadenbremse, Kordier-oder Kabliermaschine mit einer Außenfadenbremse and Verfahren zum Betreiben einer solchen Kordier-oder Kabliermaschine", the entire contents of which are incorporated herein by reference.

FIELD OF THE INVENTION

The invention relates to an outer-yarn brake for a cording or cabling machine, a cording or cabling machine with an outer-yarn brake and a method for operating such a cording or cabling machine.

BACKGROUND OF THE INVENTION

Cording or cabling machines with outer-yarn brakes have been known and documented for a considerable amount of time in various embodiments. Such outer-yarn brakes are conventionally arranged downstream of the feed bobbin in order to supply an outer yarn in the yarn withdrawal direction and designed to charge the yarn withdrawn from the feed bobbin with a defined yarn tension. Such a cording and cabling machine is previously known, for example, from the documents German Patent Publication DE 41 21 913 A1 and European Patent Publication EP 0 534 287 A1. In this machine, the outer-yarn brake is arranged at the height of a spindle, wherein the braked yarn is guided by means of deflection rollers into the spindle.

By way of example, FIG. 1 shows schematically a further arrangement of an outer-yarn brake 1 in a cabling machine previously known, for example, from German Patent Publication DE 10 2007 043 352 A1. The outer-yarn brake 1 is held by a pivotable bobbin rack 2 close to a feed bobbin 4 above a cabling station 5, in order to tension the yarn 6 coming from the bobbin rack 2 in a defined manner and allow it to run in a stretched manner without further deflection into a free end-portion 8 of a yarn-guide channel 10. The yarn-guide channel 10 allows a controlled and unhindered guiding of the yarn 6 around an outer region of the cabling station 5 up to a yarn input of a cabling spindle 12 arranged below the cabling station 5. The yarn 6 is threaded into the outer-yarn brake 1 either by hand or by means of corresponding threading aids, such as long synthetic-material wires. For this purpose, the bobbin rack 2 should be pivoted downwards. In the yarn-guide channel 10, the yarn 6 is threaded by means of a pneumatic threading device 11 arranged adjacent to the yarn-guide channel 10. Furthermore, the arrangement shown means that, in the case of a setting or respectively an adjustment of a braking action of the outer-yarn brake 1 on the basis of the structural height, the bobbin rack 2 must be pivoted downwards several times. In general, this also changes the yarn pathway, so that the deflection angle of the yarn and accordingly a storage of the yarn and also the yarn tension is changed. As a result, the bobbin rack 2 must be pivoted upwards again in order to check the storage.

These known arrangements have in common the fact that, in the case of a yarn breakage, outer yarns are drawn out of the spindle region into the region of a directly adjacent workstation and can therefore cause further disturbances, for example, so-called serial breakages.

SUMMARY OF THE INVENTION

Starting from the prior art, it is the object of the present invention to provide an improved cording or cabling machine by means of which, in particular, a risk of a yarn being pulled out in the event of a yarn breakage can be reduced, preferably avoided, and furthermore, the threading process and preferably a setting or adjustment of the braking action of the outer-yarn brake can preferably be simplified. In particular, one object of the present invention is to provide an outer-yarn brake suitable for this purpose.

According to one aspect of the present invention, this object is addressed by an outer-yarn brake for a cording or cabling machine with at least one workstation comprising a bobbin rack for holding at least one feed bobbin, a spindle for the rotation of a yarn withdrawn from the feed bobbin around a bobbin pot associated with the spindle, and a yarn-guide channel for guiding the yarn received via a free end-portion of the yarn-guide channel to the spindle. The outer-yarn brake can be arranged in the yarn running direction of the withdrawn yarn between the feed bobbin and the yarn-guide channel in order to guide through the withdrawn yarn and comprises a clamping portion for the defined braking of the movement of the yarn running through. According to the invention, the outer-yarn brake can be coupled to the free end-portion in order to form a yarn input for the yarn-guide channel.

Further advantageous embodiments of the outer-yarn brake are more fully described hereinafter.

The proposed outer-yarn brake is designed for a cording or cabling machine with at least one workstation, wherein the workstation comprises a bobbin rack for holding at least one feed bobbin, a spindle for the rotation of a yarn withdrawn from the feed bobbin around a bobbin pot associated with the spindle, and a yarn-guide channel for guiding the yarn received via a free end-portion of the yarn-guide channel to the spindle. Dependent upon the design of the machine, the spindle can be a cording or respectively cabling spindle. The free end-portion of the yarn-guide channel preferably comprises a yarn input opening embodied in the direction of the bobbin rack, in order to receive the withdrawn yarn without interposed deflection means outside a cabling or respectively cording station. The outer-yarn brake can be arranged in the yarn running direction of the withdrawn yarn between the feed bobbin and the yarn-guide channel in order to guide through the withdrawn yarn and comprises a clamping portion for the defined braking of a movement of the running yarn.

The proposed outer-yarn brake is characterized in that the outer-yarn brake can be coupled to the free end-portion of the yarn-guide channel in order to form a yarn input for the yarn-guide channel. As a result, an otherwise conventional free space between an output of the outer-yarn brake and an input opening of the yarn-guide channel can be dispensed with, so that a yarn emerging from the outer-yarn brake can enter directly into the free end-portion of the yarn-guide channel. Accordingly, after entry into the outer-yarn brake, the yarn can be guided seamlessly to the cabling spindle, wherein the yarn-guide channel is preferably constituted with at least one deflection portion in order to implement the deflection of the yarn required for this purpose. In the event of a yarn breakage, the risk of a wandering yarn end associated with the yarn being pulled out from the spindle region can be reduced and ideally avoided by means of a holding of the yarn in the clamping portion of the outer-yarn brake. Furthermore, the yarn can be threaded in one step via the outer-yarn brake, the yarn-guide channel and the spindle, thereby shortening the threading process. Furthermore, a setting or respective adjustment of the braking action of the outer-yarn brake can be implemented in a simplified manner on a new yarn without the necessity for multiple pivoting of the bobbin rack, so that, furthermore, the storage of the yarn can be observed at the same time, which corresponds to the real storage during the production process. In this context, a setting or transfer of new values can also be implemented in a shorter time on all outer-yarn brakes or more specifically all outer-yarn brakes of the machine.

According to one preferred embodiment, the outer-yarn brake can be positioned rigidly on the free end-portion of the yarn-guide channel and by further preference fixed to the free end-portion. The positioning or fixing can take place by means of a holding means. For example, a holder coupled or capable of being coupled to the outer-yarn brake can be provided, which can be fixed to the cording or respectively cabling machine.

Alternatively or additionally, the positioning or fixing can be implemented with further fastening means, which are constituted with the outer-yarn brake. For example, according to a further preferred embodiment, the outer-yarn brake can comprise a yarn output capable of being plugged, snapped or rotated into or onto the free end-portion, by further preference with the interposition of a sealing ring, such as an O-ring. The interposition of the sealing ring favors the avoidance of a leakage or respective supply of an external air stream and has an advantageous effect with regard to a balancing of tolerances. In a different or an additional manner, the yarn output can be coupled to the free end-portion via a press-on seating. Alternatively or additionally, the yarn output can be connected to the free end-portion via a snap-in connection. Alternatively or additionally to this, the yarn output can also be connected to the free end-portion via a srew-thread connection.

According to one preferred embodiment, the yarn output can comprise a shoulder portion, wherein the shoulder portion is arranged upstream of the yarn output in the yarn running direction, and the yarn output is constituted for insertion into or placing onto the free end-portion. The shoulder portion can preferably be provided on the free end-portion in the assembled condition of the outer-yarn brake. The shoulder portion can accordingly define a stop for the installation of the outer-yarn brake on the free end-portion, so that the outer-yarn brake can be coupled more simply, reliably and quickly to the free end-portion.

Furthermore, in an alternative or additionally preferred manner, a projection extending from the shoulder portion or a further external shoulder portion can project parallel to the yarn output, which constitutes a pneumatic connection for the pneumatic release of the outer-yarn brake or more specifically of the clamping portion. Accordingly, the outer-yarn brake can be constituted with reduced structural volume in the radial direction.

By further preference, an intermediate space accordingly embodied between the projection or respectively the pneumatic connection and the yarn output is constituted for the fixed accommodation of a tubular wall portion of the free end-portion without hindering the possibility of connecting the pneumatic connection. The fixed accommodation can be implemented, for example, by means of clamping and/or snap-in connection. For the first of these, the intermediate space must be embodied in such a manner that a clamping effect is achieved between yarn output, projection and intervening tubular wall portion. For the latter, the projection can comprise a snap-in connecting means, which can be actively connected to the free end-portion with a counter-snap-in connecting means. Alternatively or also additionally to this, the fixed accommodation can preferably take place through the provision of an adhesive surface between mutually contacting surfaces of the outer-yarn brake and of the free end-portion. As a further alternative, a srew-thread portion on the projection or respectively the pneumatic connection or the yarn output disposed opposite to the latter is also conceivable for fixing the outer-yarn brake onto the free end-portion. Accordingly, a functional combination of the projection or respectively of the pneumatic connection can be achieved, so that a further simplification of the construction of the outer-yarn brake is achieved.

According to one preferred embodiment, a yarn-passage portion of the outer-yarn brake disposed downstream of the clamping portion in the yarn running direction comprises a contact portion for contact on an associated counter-contact portion of the free end-portion, wherein the contact portion at least partially surrounds a yarn-outlet opening with an opening width which is larger than or equal to an opening width of a yarn input opening surrounded by the counter contact portion, which adjoins the yarn-outlet opening in the yarn running direction. In a further preferred manner, the contact portion can be a shoulder portion, as described above, which serves as a stop for the relative movement between outer-yarn brake and the free end-portion during the installation of the outer-yarn brake. The yarn passage portion of the outer-yarn brake preferably merges seamlessly and therefore without disturbance into the free end-portion, approximately or completely in the yarn running direction. Accordingly, an impairment of the yarn properties, for example, through friction of the yarn against otherwise projecting edges or points in the region of the transition can be reduced.

By further preference, the yarn-outlet opening defines a yarn input, a yarn passage or a yarn output of a nozzle formed in the yarn running direction, which, in the region of the transition of the outer-yarn brake to the free end-portion, is constituted correspondingly from the yarn passage portion of the outer-yarn brake and/or a yarn passage portion of the free end-portion. By means of the nozzle, the suction effect in the transitional region of the outer-yarn brake to the free end-portion can be improved, so that the threading through the outer-yarn brake and the yarn-guide channel into the outer region of the spindle can be implemented more reliably. The opening width of the yarn-outlet opening is slightly larger than the opening width of the yarn inlet opening as a result of the adjacent arrangement in the yarn inlet opening, wherein the sizes of the opening width are adapted in such a manner that the yarn passage portion of the outer-yarn brake merges, approximately or ideally seamlessly, into the yarn passage portion of the free end-portion.

According to one preferred embodiment, the yarn brake portion comprises a brake element mounted between an upper and lower braking surface which can be moved pneumatically into a threading position for the threading of the withdrawn yarn, wherein at least one of the braking surfaces is integrated in a piston mounted in an axially displaceable manner, on which a biasing of at least one spring element acts in order to specify a braking force. In this manner, a variable biasing of the spring element and accordingly a contact pressure of the brake element on the braking surface can be achieved. The pneumatic mobility of the brake element also achieves a simplified threading of the yarn.

According to a further preferred embodiment, the upper braking surface is integrated in an upper piston, which embodies the piston mounted in an axially displaceable manner such that the upper piston is guided with play inside a housing of the outer-yarn brake so that the upper piston can escape, if necessary, into a position in which a mid-longitudinal axis of the upper piston forms an angle with a mid-longitudinal axis of the housing. The outer-yarn brake accordingly comprises an embodiment internal to the housing, previously known, for example, from German Patent Publication DE 10 2009 058 979 A1, which has previously been used exclusively for pot-yarn brakes in two-for-one twisting machines, which are arranged in the region of a hollow axle of a spindle. An embodiment for an outer-yarn brake otherwise known only for this region can therefore be used in a cabling or respectively cording process.

By preference, the outer-yarn brake according to a further embodiment comprises an embodiment corresponding to one of the further embodiments described in German Patent Publication DE 10 2009 058 979 A1. As a result, the corresponding advantages can also be used for the outer-yarn brake. For example, the angle which is set in the case of the occurrence of yarn anomalies between the mid-longitudinal axis of the upper piston and the mid-longitudinal axis of the housing of the yarn brake can be up to 100°. Furthermore, the upper piston can preferably comprise a disc-shaped lower guide shoulder, the diameter of which is disposed below the internal diameter of the housing in the operating region of the guide shoulder. In an advantageous embodiment, the disc-shaped lower guide shoulder can comprise a convex curved peripheral guide surface.

In a preferred manner, the upper piston can be charged by two spring elements arranged one behind the other, which each comprise different spring characteristics, wherein their biasing is preferably adjustable in a defined manner via a rotatably mounted clamping device.

Furthermore, the lower braking surface, onto which the braking element is pressed, can preferably be integrated in a lower piston, which is positioned in an operating position, biased by a spring element, and can be lowered pneumatically into a threading position for the threading of a new yarn. For example, the pneumatic connection can be provided for this purpose through a corresponding active connection.

Furthermore, it can be provided by preference that a support element mounted with limited movement in the axial direction is arranged in the region of the brake element, which is positioned by the lower piston in a resting position during the operation of the workstation, and which, during the lowering of the lower piston into its threading position, slides into an intermediate position in which the braking element is positioned eccentrically. For the guiding of the braking element, the support element preferably further comprises an inclined plane which ensures an eccentric positioning of the braking element. In this context, the eccentric position is preferably specified by a retaining pocket which is set into the lower piston.

As an alternative, a support element can be installed on the housing, preferably in the region of the braking element, on which the braking element is disposed during the lowering of the lower piston into its threading position. In this context, the support element is preferably constituted in such a manner that, even with the braking element in place, sufficient space is available between the support element and braking element, so that with this embodiment it is also guaranteed that new yarns can be threaded without difficulty.

Furthermore, in a preferred manner, it can be provided that the braking element constituted as a ball brake and/or the braking elements are made from hardened steel or the ball brake and/or the braking surfaces are manufactured from a ceramic-oxide material.

As an alternative to the previously described outer-yarn brake, preferably constituted and used as a pneumatically threadable ball yarn brake, the outer-yarn brake can also be based on the principle of a pneumatically threaded capsule yarn break, which, by way of difference from the ball yarn brake, comprises a capsule brake as the braking element instead of a ball brake. As a further alternative, for example, conventional pneumatically threadable capsule yarn brakes can be used, of which the yarn output is adapted in a manner and means as described above for direct coupling with the free end-portion of the yarn-guide channel. As an alternative, for example, a correspondingly modified adapter can be used for the coupling of a conventional pot yarn brake.

According to a further aspect of the present invention, the object set forth above is achieved by a cording or cabling machine. A cording or cabling machine is also understood to include such combination machines which comprise, inter alia, a cording or cabling function. For example, such a combination machine can be a two-for-one twisting and cabling machine which can be used optionally.

The cording or cabling machine comprises at least one workstation comprising a bobbin rack for holding at least one feed bobbin, a cabling spindle for the rotation of a yarn withdrawn from the feed bobbin around a bobbin pot associated with the cabling spindle, and a yarn-guide channel for guiding the yarn withdrawn from the feed bobbin to the cabling spindle, wherein the yarn-guide channel comprises a free end-portion arranged outside the bobbin pot for receiving the withdrawn yarn. The cording or cabling machine is characterized in that the workstation comprises an outer-yarn brake according to any one of the previously described embodiments, wherein the outer-yarn brake is coupled to the free end-portion in order to constitute a yarn input for the yarn-guide channel. Accordingly, the advantages described above or respectively derivable from the preferred embodiments can be achieved in a corresponding manner.

By preference, a preliminary brake is arranged between the feed bobbin and the outer-yarn brake to stretch the yarn extending to the outer-yarn brake. Embodiments of preliminary brakes are known from the prior art and do not belong to the core of the invention. With such preliminary brakes, the yarn can be threaded in without auxiliary tools. By means of an arrangement of such a preliminary brake according to the preferred embodiment, the yarn can be held stretched and advantageously introduced in a corresponding manner into the outer-yarn brake and the yarn-guide channel.

Alternatively or additionally, a threading device is arranged adjacent to the outer-yarn brake for threading the outer yarn into the outer-yarn brake. The threading device can be, for example, a conventional knee lever, which is coupled with a vacuum-pressure supply device, to which the yarn-guide channel is connected, in order to initiate a suction flow in the yarn-guide channel by activating the knee lever in such a manner that a yarn capable of being sucked in via the outer-yarn brake is blown out in the region of the spindle for further handling. At the same time as the activation of the knee lever, an air supply can be provided, by means of which the lowering of the piston of the outer-yarn brake into the threading position is achieved. With the threading device, a threading of the outer yarn into the outer-yarn brake, the yarn-guide channel and the spindle can be implemented with reduced effort in one operating step.

According to a further aspect of the present invention, the above described object is achieved by a method suitable for the operation of a conventionally constituted cording or cabling machine with at least one workstation comprising a bobbin rack for holding at least one feed bobbin, a cabling spindle for the rotation of a yarn withdrawn from the feed bobbin around a bobbin pot associated with the cabling spindle, and a yarn-guide channel for guiding the yarn withdrawn from the feed bobbin to the cabling spindle. The method is characterized in that the method comprises a step of yarn-braking by means of an outer-yarn brake constituting a yarn input of the yarn-guide tube. The outer-yarn brake can be one of the preferred embodiments described above.

By means of such an outer-yarn brake, a self-cleaning effect of the outer-yarn brake can also be achieved during the jetting of the outer yarn.

Further features and advantages of the invention are specified in the following description of preferred exemplary embodiments of the invention on the basis of the drawing figures which show details substantial to the invention, and in the patent claims. The individual features can be realised in a preferred embodiment of the invention, in each case individually by themselves or in multiples in arbitrary combination.

BRIEF DESCRIPTION OF THE DRAWINGS

Preferred exemplary embodiments of the invention are explained in greater detail below on the basis of the attached drawings, wherein.

DETAILED DESCRIPTION OF THE INVENTION

In the following description of preferred exemplary embodiments of the present invention, the same or similar reference numbers are used for elements illustrated in the various drawings which operate in a similar manner, wherein the description of these elements is not repeated.

Figure 1:
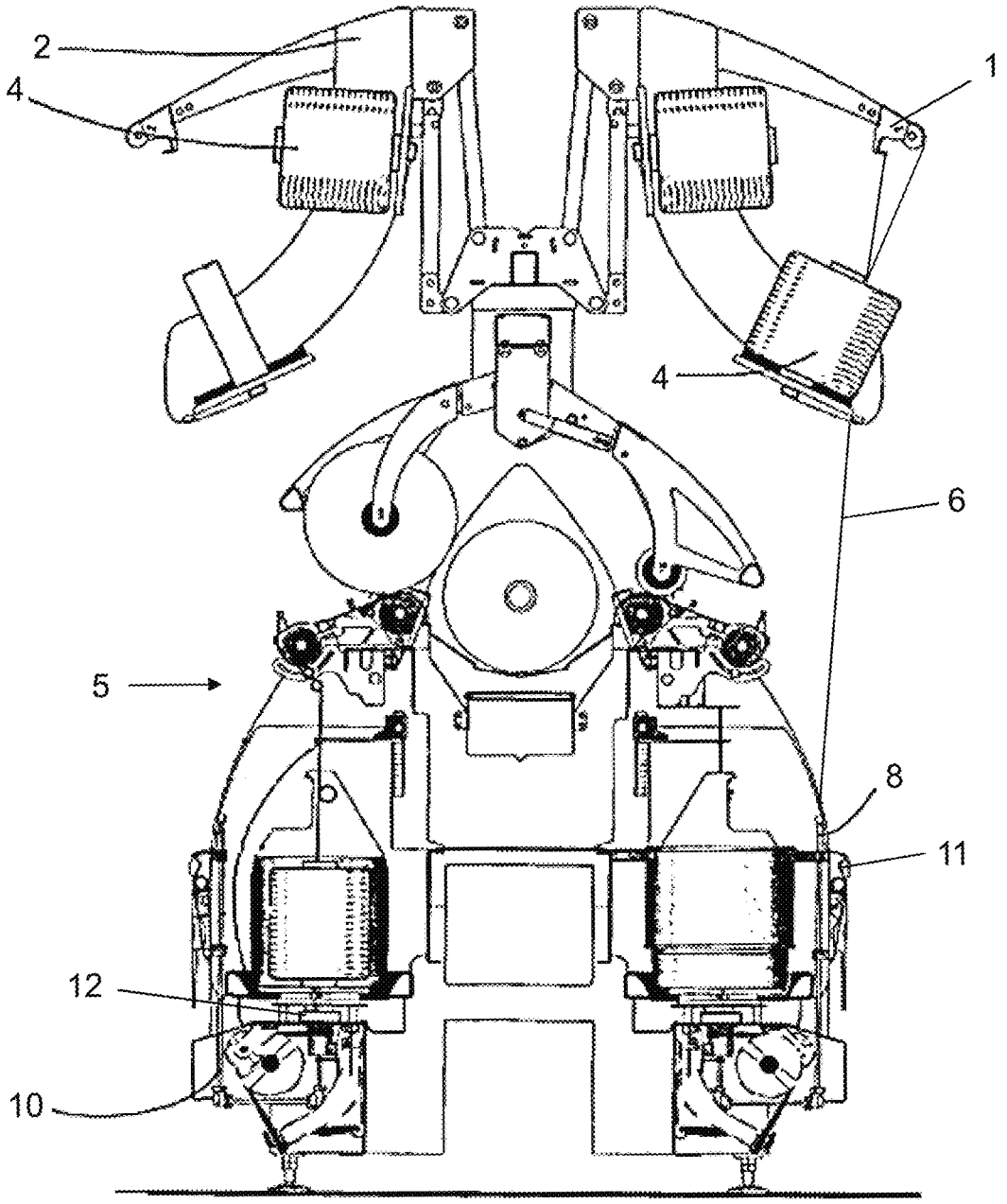
FIG. 1 is a schematic lateral view of a workstation in a previously known cording or cabling machine.

FIG. 1 shows schematically a lateral view of the workstation of a previously known cording or cabling machine described in the introduction.

Figure 2:
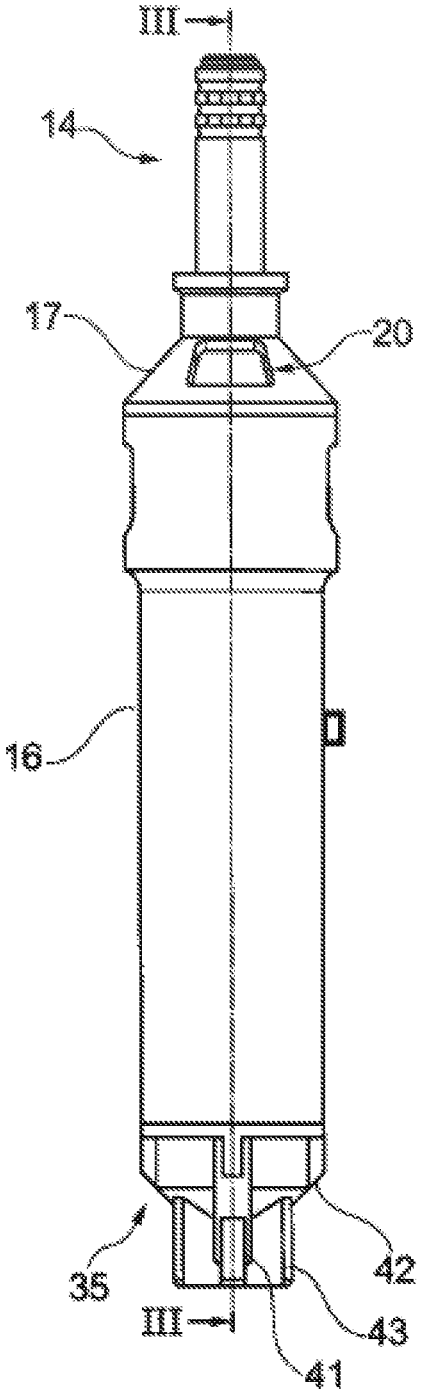
FIG. 2 is a schematic front view of an outer-yarn brake according to a preferred exemplary embodiment.
Figure 3:
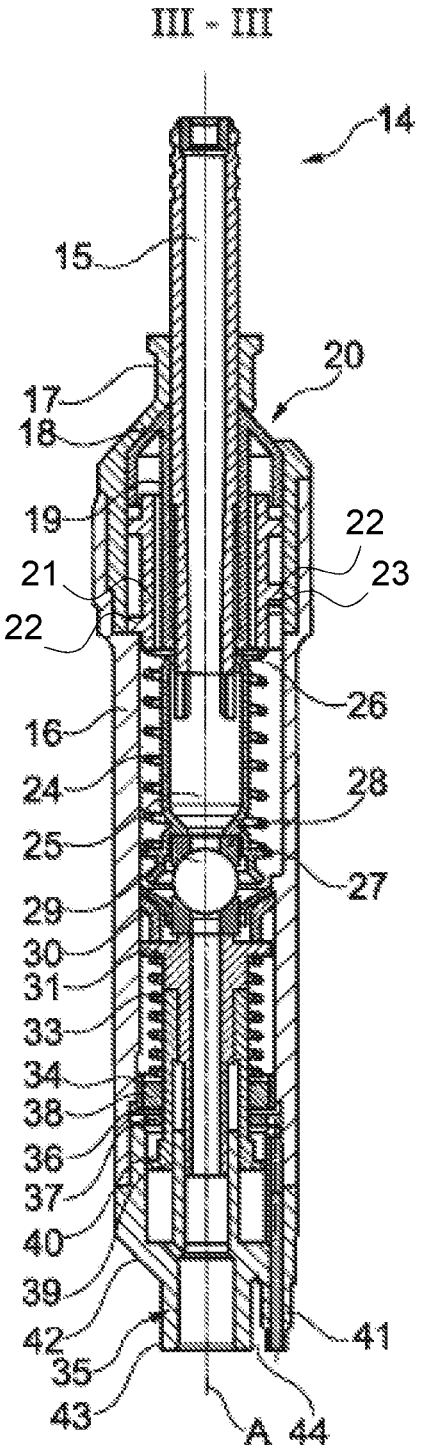
FIG. 3 is a schematic sectional view of the outer-yarn brake illustrated in FIG. 2 along the sectional line III-III.

FIGS. 2 and 3 show a schematic front view and sectional view along the sectional line III-III of an outer-yarn brake 14 according to a preferred exemplary embodiment. The outer-yarn brake 14 is constructed in a similar manner to the pot yarn brake previously known from German Patent Publication DE 10 2009 058 979 A1 named above.

The outer-yarn brake 14 comprises a tubular housing 16, which comprises at its yarn-input end a snap-in connection (not designated in greater detail) and, at a yarn-output end, an internal screw thread (not designated in greater detail). Over the snap-in connection provided at the upper end, a lid 17 is locked into the housing 16, which, on the one hand, guides a rotatable yarn inlet tube 15, which is coupled to a scale element 18 arranged inside the lid 17, spring-loaded by means of a compression spring element 19. In the region of the contact surface of the scale element 18, the lid 17 comprises a window 20, through which scale values printed in a corresponding position on the scale element 18 can be read. In an alternative manner, the lid 17 can be screwed into the housing 16 according to an exemplary embodiment, which is not illustrated.

The first spring element 19 impinges on a counter-bearing element 21 constituted as a sleeve, guided on the inner wall of the lid 17 and connected to the yarn-inlet tube 15, which can occupy a plurality of snap-in positions arranged in a spiral manner. For this purpose, the lid 17 comprises an internal stationary cam 23, which engages in each case with projections 22 arranged in a spiral manner in the external surface of the counter-bearing element 21 at the snap-in positions.

By pulling and simultaneous rotation of the yarn-inlet tube 15, one of the projections 22 arranged in a spiral manner comes into contact with the cam 23 in order to set the axial position of the counter-bearing element 21 in a defined manner in the housing 16. Since the axial position of the counter-bearing element 21 specifies the biasing of a second compression spring element 24, the braking force of the outer-yarn brake 14 can be adjusted in a defined manner via the yarn-inlet tube 15 in conjunction with the counter-bearing element 21 as a clamping device and displayed through the window 20 by means of a corresponding scale value.

An upper piston 25 arranged in the housing 16, coupled with an internal end of the yarn-inlet tube 15 is mounted in a known manner via a lower and upper guide shoulder 26, 27, wherein the second compression spring element 24 is supported on the lower guide shoulder 27. The upper piston 25 is mounted, both in the region of the upper 26 and also in the region of the lower guide shoulder 27, with a play.

Furthermore, an annular insert manufactured from wear-resistant material, for example, hardened steel or ceramic-oxide material, is attached to the upper piston 25, which, in combination with a braking element 29, preferably a ball brake, forms an upper braking surface 28.

The ball brake 29, which is preferably also manufactured from a wear-resistant material, is disposed on a lower braking surface 30 in a manner spring-loaded by the spring force of the compression spring elements 19, 24 described previously. Like the upper braking surface 28, the lower braking surface 30 is preferably also constituted as an annular insert and manufactured from hardened steel or ceramic-oxide material. The lower braking surface 30 is accordingly arranged in a lower piston 31, which is positioned in a manner spring-loaded by a third compression spring element 33.

The third compression spring element 33 is supported on a side facing away from the lower braking surface 30 on an intermediate insert 34, which is fixed in an end region 36 of a lower lid 35, which is inserted into the lower internal screw thread of the housing 16, by means of an interposed stopping ring 37. A sealing rod 38 is provided between the stopping ring 37 and the intermediate insert 34. The lower lid 35 bears a pneumatic cylinder 39 controllable in a targeted manner, which is in contact on an internal wall of the lower lid 35 with a seal 40 and is coupled via an active connection with a pneumatic connector 41 for the operation of the pneumatic cylinder 39 by means of a supply of compressed air. Alternatively, according to an exemplary embodiment which is not illustrated, the active connection between the pneumatic connector 41 and the pneumatic cylinder 39 can be realised in that the pneumatic cylinder 39 can be moved via the pneumatic connector 41 by means of a supply of vacuum pressure.

The pneumatic connector 41 is integrated in the lower lid 35 and projects from a shoulder-surface portion 42 parallel to a yarn-guide axis A of the outer-yarn brake 14 at a distance from a yarn output 43 extending along the yarn-guide axis A. According to an exemplary embodiment which is not illustrated, a resulting interposed intermediate space 44 is constituted in such a manner that a tubular-wall end-portion of a free end-portion 8 of a yarn-guide channel 10 shown by way of example in FIG. 1 can be accommodated, preferably in a clamping manner, wherein the yarn output 43 is inserted or plugged into a hollow axle of the yarn-guide channel 10. In this manner, the outer-yarn brake 14 can be positioned on the free end-portion 8 without great effort and fixed to the latter.

Figure 4:
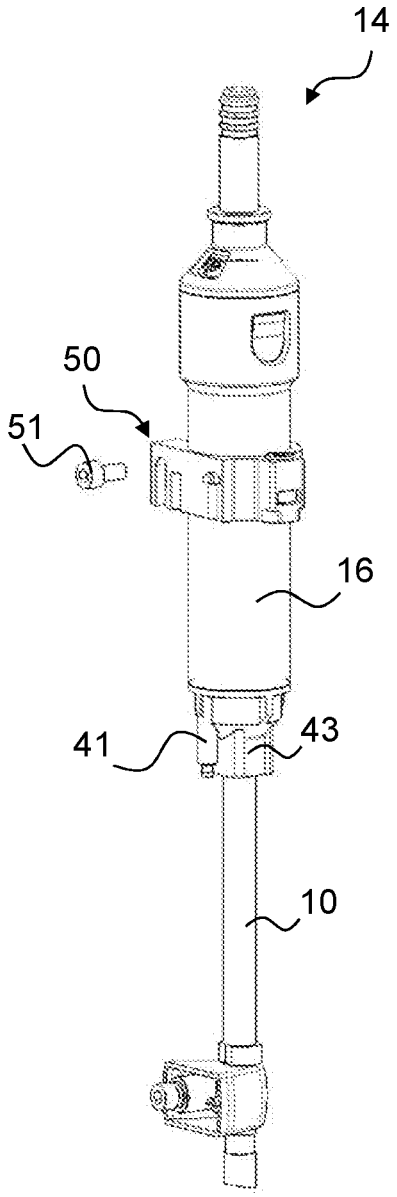
FIG. 4 is a perspective lateral view of the outer-yarn brake illustrated in FIGS. 2 and 3 in the assembled condition.

FIG. 4 shows a perspective lateral view of the outer-yarn brake 14 illustrated in FIGS. 2 and 3 in an assembled condition according to one exemplary embodiment, in which the yarn output 43 accommodates a free end-portion 8 of a yarn-guide channel 10 of a cabling machine as shown by way of example in FIG. 1. In this context, the outer-yarn brake 14 is installed on a free end-portion 8 of a yarn-guide channel 10. The housing 16 of the outer-yarn brake 14 is framed by a holder 50. The holder 50 is fixed to the outer-yarn brake 14 at least in a rotationally fixed manner via a snap-in device constituted as a slot and key connection. For this purpose, a spring is arranged on the outside of the housing 16, which engages in a groove formed with the holder 50, which comprises a stop, on which the spring is supported in the yarn running direction. By means of the holder 50, the outer-yarn brake 14 can be attached to a component of the cording or cabling machine in an anti-twist and non-slip manner in the yarn running direction of the yarn 6. With this preferred exemplary embodiment, the attachment is implemented by means of fastening screws 51. Other conventional force-fit or form-fit fastening options are conceivable as an option.

Figure 5:
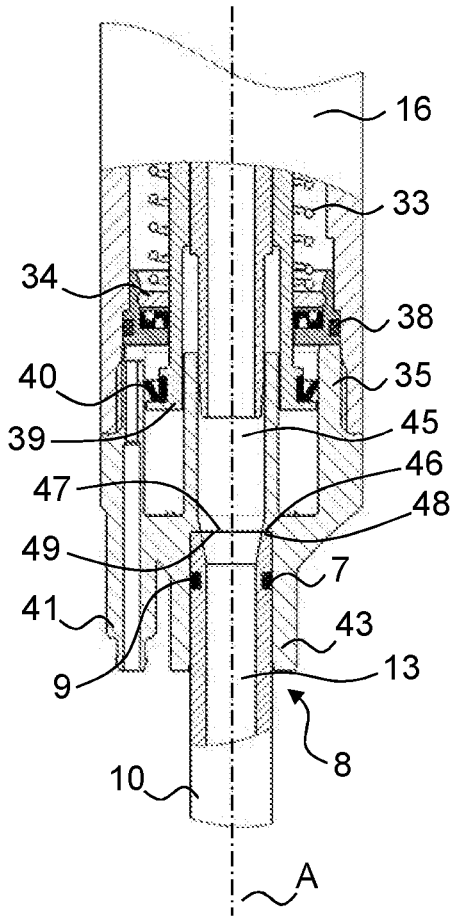
FIG. 5 is a schematic, partial sectional view of the outer-yarn brake illustrated in FIG. 4.

FIG. 5 shows a schematic, partial sectional view of the outer-yarn brake 14 shown in FIG. 4 in the coupling region of the yarn output 43 and of the free end-portion 8 of the yarn-guide channel 10. The yarn output 43 is disposed on the free end-portion 8, which comprises a sealing ring 7 inserted in an annular groove 9 on the outer periphery, in order to seal off the contact surfaces between yarn output 43 and the free end-portion 8. Accordingly, a leakage or respectively a supply of external air can be reliably avoided. Furthermore, a balancing of tolerances between the outer-yarn brake 14 and the yarn-guide channel 10 can be achieved in a simplified manner.

A yarn-passage portion 45 of the yarn output 43 and a yarn-passage portion 13 of the free end-portion 8 are constituted in such a manner that, in the installed condition of the outer-yarn brake 14, they constitute a nozzle acting in the yarn running direction. For this purpose, the respective yarn-passage portion 13, 45 is constituted in a tapering manner in cross-section in the yarn running direction, wherein the yarn-passage portion 45 comprises a yarn-outlet opening 47 with an opening width, which is approximately equal to an opening width of an adjacent yarn-input opening 49 of the yarn-passage portion 13 of the free end-portion 8. The respective yarn-outlet opening 47 and yarn-inlet opening 49 are surrounded by a contact portion 46 or respectively counter-contact portion 48, which, in the illustrated installed condition are in contact with one another. The yarn passage portion 45 and the yarn passage portion 13 accordingly merge into one another in a seamless and shoulder-free manner. The constituted nozzle favors a suction flow achievable in the yarn-guide channel 10 and the outer-yarn brake 14 for sucking or respectively threading in the yarn 6.

According to a preferred exemplary embodiment, the outer-yarn brake 14 illustrated in FIGS. 2 to 5 can therefore advantageously be installed in existing cording or cabling machines, as shown by way of example in FIG. 1, without substantial changes to the machine or respectively adaptations of the latter. In the assembled condition, the outer-yarn brake 14 forms a yarn input for the yarn-guide channel, so that the yarn can be guided without transition, in other words, without passing through an open sub-region, into the yarn-guide channel and to the spindle. Furthermore, it is possible, as a result, to dispense with an outer-yarn brake 1 in the bobbin rack 2. Instead of the conventional outer-yarn brake 1, a cost-favorable preliminary brake can be installed, in order to introduce the yarn 6 in a stretched manner into the outer-yarn brake 14 which can be fitted on the yarn-guide channel 10. Accordingly, not only new cording and cabling machines can be fitted with an outer-yarn brake 14 as described above, but already-used textile machines can also be fitted with such an outer-yarn brake without great effort.

Figure 6:
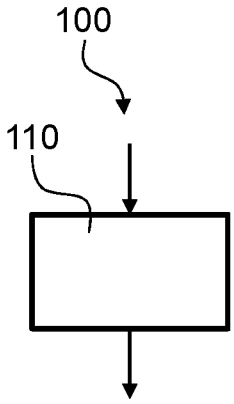
FIG. 6 is a flow diagram of a method for the operation of a cording or cabling machine according to a preferred exemplary embodiment.

FIG. 6 shows a flow diagram of a method 100 for the operation of a cording or cabling machine according to a preferred exemplary embodiment. The cording or cabling machine can be like the one illustrated in FIG. 1, which is fitted with an outer-yarn brake 14 as described previously. The method comprises a method step 110 of yarn braking by means of the outer-yarn brake 14 constituting a yarn input of the yarn-guide channel. Accordingly, in the case of a yarn breakage of the outer yarn withdrawn from the feed bobbin, for example, in the balloon region, it can be reliably prevented that the outer yarn is pulled out of the yarn-guide channel and out of the spindle region and wanders into an adjacent region. Because, in this case, the outer-yarn brake guarantees a clamping of the outer yarn pulled through the outer-yarn brake.

The exemplary embodiments described and shown in the FIGS. are selected only by way of example. Different exemplary embodiments can be combined with one another in their entirety or with reference to individual features. One exemplary embodiment can also be supplemented by features of a further exemplary embodiment.

If an exemplary embodiment includes an "and/or" link between a first feature and a second feature, this can be read in such a manner that the exemplary embodiment according to one embodiment comprises both the first feature and also the second feature, and according to a further embodiment, comprises either only the first feature or only the second feature.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

What is claimed is:

1. An outer-yarn brake for a cording or cabling machine with at least one workstation comprising a bobbin rack for holding at least one feed bobbin, a spindle for the rotation of a yarn withdrawn from the feed bobbin around a bobbin pot associated with the spindle, and a yarn-guide channel for guiding the yarn received via a free end-portion of the yarn-guide channel to the spindle; wherein the outer-yarn brake is arranged in the yarn running direction of the withdrawn yarn between the feed bobbin and the yarn-guide channel in order to guide through the withdrawn yarn and comprises a clamping portion for the defined braking of the movement of the yarn running through, characterized in that the outer-yarn brake is coupled to the free end-portion of the yarn-guide channel forming a yarn input for the yarn-guide channel.

2. The outer-yarn brake according to claim 1, characterized in that the outer-yarn brake is positioned rigidly on the free end-portion of the yarn-guide channel.

3. The outer-yarn brake according to claim 1, characterized in that the outer-yarn brake comprises a yarn output plugged, snapped or twisted into or onto the free end-portion.

4. The outer-yarn brake according to claim 3, characterized in that the yarn output is preceded by a shoulder portion, from which a projection extending parallel to the yarn output projects, which constitutes a pneumatic connection for the pneumatic release of the outer-yarn brake.

5. The outer-yarn brake according to claim 1, characterized in that a yarn-passage portion of the outer-yarn brake disposed downstream of the clamping portion in the yarn running direction comprises a contact portion for contact on an associated counter-contact portion of the free end-portion, wherein the contact portion surrounds a yarn-outlet opening with an opening width which is larger than or equal to an opening width of a yarn input-opening surrounded by the counter-contact portion, which adjoins the yarn-outlet opening in the yarn running direction.

6. The outer-yarn brake according to claim 5, characterized in that the yarn-outlet opening defines a yarn input, a yarn passage or a yarn output of a nozzle formed in the yarn running direction.

7. The outer-yarn brake according to claim 1, characterized in that the clamping portion comprises a brake element mounted between an upper and lower braking surface, which is moved pneumatically into a threading position for the threading of the withdrawn yarn, wherein at least one of the braking surfaces is integrated in a piston mounted in an axially displaceable manner, on which a biasing of at least one spring element acts in order to specify a braking force.

8. The outer-yarn brake according to claim 7, characterized in that the upper braking surface is integrated in an upper piston, which constitutes the piston mounted in an axially displaceable manner such that the upper piston is guided with play inside a housing of the outer-yarn brake so that the upper piston escapes into a position in which a mid-longitudinal axis of the upper piston forms an angle with a mid-longitudinal axis of the housing.

9. A cording or cabling machine with at least one workstation comprising a bobbin rack for holding at least one feed bobbin, a spindle for the rotation of a yarn withdrawn from the feed bobbin around a bobbin pot associated with the spindle, and a yarn-guide channel for guiding the yarn withdrawn from the feed bobbin to the spindle, wherein the yarn-guide channel comprises a free end-portion arranged outside the bobbin pot in order to receive the withdrawn yarn; characterized in that the workstation comprises an outer-yarn brake, wherein the outer-yarn brake is coupled to the free end-portion in order to form a yarn input for the yarn-guide channel.

10. The cording or cabling machine according to claim 9, characterized in that a preliminary brake for stretching the yarn running towards the outer-yarn brake is arranged between the feed bobbin and the outer-yarn brake, and/or a threading device for the threading of a yarn into the outer-yarn brake is arranged adjacent to the latter.

11. A method for operating a cording or cabling, machine with at least one workstation comprising a bobbin rack for holding at least one feed bobbin, a cabling spindle for the rotation of a yarn withdrawn from the feed bobbin around a bobbin pot associated with the cabling spindle, and a yarn-guide channel for guiding the yarn withdrawn from the feed bobbin to the cabling spindle; characterized in that the method comprises coupling an outer-yarn brake to a free end-portion of the yarn-guide channel constituting a yarn input of the yarn-guide channel.

12. The outer-yarn brake according to claim 1, characterized in that the outer-yarn brake is fixed to the free end-portion.

13. The outer-yarn brake according to claim 1, characterized in that the outer-yarn brake comprises a yarn output capable of being plugged, snapped or twisted into or onto the free end-portion with the interposition of a sealing ring.

* * * * *